US008925426B2

(12) United States Patent
Shishkin et al.

(10) Patent No.: US 8,925,426 B2
(45) Date of Patent: Jan. 6, 2015

(54) ADJUSTABLE NUT WRENCH AND A METHOD OF A JAW LOCKING

(76) Inventors: Valery Shishkin, Voorhees, NJ (US); Pavel Shishkin, Kiev (UA)

( * ) Notice: Subject to any disclaimer, the term of this patent is extended or adjusted under 35 U.S.C. 154(b) by 195 days.

(21) Appl. No.: 13/466,336

(22) Filed: May 8, 2012

(65) Prior Publication Data

US 2013/0298736 A1 Nov. 14, 2013

(51) Int. Cl.
*B25B 13/12* (2006.01)
*B25B 13/18* (2006.01)

(52) U.S. Cl.
CPC ..... *B25B 13/18* (2013.01); *B25B 13/12* (2013.01)
USPC ..... 81/129; 81/129.5

(58) Field of Classification Search
USPC ..... 81/126–129, 129.5, 135, 163, 165, 167
See application file for complete search history.

(56) References Cited

U.S. PATENT DOCUMENTS

| | | | | | |
|---|---|---|---|---|---|
| 41,100 | A * | 1/1864 | Sharp | 81/128 |
| 170,201 | A * | 11/1875 | Stanton | 81/409 |
| 272,526 | A * | 2/1883 | Calef | 81/129 |
| 297,640 | A * | 4/1884 | Schmemann | 81/356 |
| 440,214 | A * | 11/1890 | Whitehill | 81/409.5 |
| 508,077 | A * | 11/1893 | Anderson | 81/97 |
| 519,254 | A * | 5/1894 | Geisendorfer | 81/99 |
| 604,526 | A * | 5/1898 | Fowler | 81/106 |
| 815,156 | A * | 3/1906 | Garrard | 81/126 |
| 1,258,396 | A * | 3/1918 | Champlin | 81/129.5 |
| 1,361,749 | A * | 12/1920 | Cazenave | 81/126 |
| 1,391,581 | A * | 9/1921 | Roberts | 81/129 |
| 1,391,898 | A * | 9/1921 | Kettler | 81/361 |
| 1,460,294 | A * | 6/1923 | Wegner | 81/328 |
| 1,556,523 | A * | 10/1925 | Hughes | 81/150 |
| 2,053,033 | A * | 9/1936 | Ibbott | 81/128 |
| 2,498,235 | A * | 2/1950 | Barber | 81/384 |
| 2,534,985 | A * | 12/1950 | Napier | 81/126 |
| 2,909,953 | A * | 10/1959 | Jansen | 81/129.5 |
| 2,943,524 | A * | 7/1960 | Bourne | 81/129 |
| 3,564,956 | A * | 2/1971 | Landen | 81/126 |
| 3,625,096 | A * | 12/1971 | Myers | 81/10 |
| 3,659,485 | A * | 5/1972 | Roth | 81/98 |
| 3,858,465 | A * | 1/1975 | Lind | 81/129 |
| 3,878,741 | A * | 4/1975 | Wilson | 81/128 |
| 3,921,477 | A * | 11/1975 | Wilson | 81/128 |
| 5,305,667 | A * | 4/1994 | Caballero | 81/165 |
| 5,542,319 | A * | 8/1996 | Wei | 81/105 |
| 5,595,098 | A * | 1/1997 | Malkin et al. | 81/165 |
| 5,823,076 | A * | 10/1998 | Binkowski | 81/127 |
| 5,894,768 | A * | 4/1999 | Malkin et al. | 81/165 |
| 5,960,683 | A * | 10/1999 | Malkin et al. | 81/165 |
| 6,101,906 | A * | 8/2000 | Tai | 81/129 |
| 6,151,996 | A * | 11/2000 | Whiteford | 81/127 |
| 6,205,892 | B1 * | 3/2001 | Davidson | 81/128 |
| 7,607,373 | B2 * | 10/2009 | Anderson | 81/129 |
| 8,485,073 | B1 * | 7/2013 | Lopez | 81/134 |
| 2006/0266164 | A1 * | 11/2006 | Gao | 81/128 |

(Continued)

*Primary Examiner* — David B Thomas

(57) ABSTRACT

An adjustable nut wrench comprising a handle section and a slide guided element that is pushed by a spring to a position where abutment surfaces are paralleled to two or three nut's sides. A first embodiment of the wrench comprises two paralleled abutment surfaces which set by the angle of maximal 60 degrees to a direction of the sliding element movement. A second embodiment of the wrench has three abutment surfaces located by the angle of 60 degrees to each other and one of them is sliding.

8 Claims, 7 Drawing Sheets

(56) References Cited

U.S. PATENT DOCUMENTS

2007/0157770 A1* 7/2007 Foltyn ..... 81/165
2011/0239832 A1* 10/2011 Arbel et al. ..... 81/129
2012/0234140 A1* 9/2012 Flamion ..... 81/99

* cited by examiner

ADJUSTABLE NUT WRENCH AND A METHOD OF A JAW LOCKING

US PATENT DOCUMENTS

| | | | |
|---|---|---|---|
| 998,462 | Jun. 27, 1911 | Curtis | 81/126 |
| 1,305,628 | Jun. 03, 1919 | Statham | 81/129 |
| 3,015,246 | Jun. 02, 1962 | Buyer | 81/167 |
| 3,173,317 | Mar. 18, 1963 | Neff | 81/167 |
| 3,956,949 | May 18, 1976 | Romano | 81/135 |
| 4,478,114 | Oct. 23, 1984 | Arena | 81/363 |
| 4,616,536 | Oct. 14, 1986 | Knebel | 81/128 |
| 4,706,528 | Nov. 17, 1987 | Inoue | 81/179 |
| 5,230,264 | Jun. 27, 1993 | Kindling | 81/129 |
| 5,528,956 | Jun. 25, 1996 | Finn | 81/356 |
| 7,096,767 | Aug. 29, 2006 | Sherburne | 81/145 |
| 7,334,507 | Feb. 26, 2008 | Piperkovski | 81/129 |

US Patent Application Pub.#2010/0083798 A1 Apr. 8, 2010, Lisle, Daniel, US Cl. 81/16.5

BACKGROUND OF THE INVENTION

The present invention refers to an adjustable wrench used for fastening threaded nuts to threaded screws or loosening nuts from threaded screws. Sets of open-end wrenches are well known having a fixed width of jaws.

In European countries and USA widely is used a wrench with parallel sliding adjustable jaws that was first invented in 1842 year by Richard Clyburn. Improvements are following. There are many forms of adjustable wrenches/spanners. Some spanners automatically adjust to size of a nut. Simpler models use a serrated edge to lock the movable jaw like was described in U.S. Pat. No. 4,572,037. Others use a transmission gear wheel to move a sliding track with a movable jaw (U.S. Pat. Nos. 5,095,782; 6,834,569 . . . ).

One of a prior art about an adjustable wrench is U.S. Pat. No. 3,015,246. It is a nut wrench that has a V-shape hook as a moveable jaw. Two faces of the hook located by the angle of 120 degrees to each other. A fixed jaw on a handle end has an abutment surface that is parallel to one side of the hook. A standard worm nut on a shank of the hook allows adjusting the wrench's width. Such a design made the wrench more stable and convenient for an operator.

Another prior art is described in U.S. Pat. No. 4,706,528. This wrench looks like a standard Construction Spud Wrench, however, it has a sliding wedge-shaped jaw portion that is located perpendicular to a jaw motion and is engaged when an object is located between jaws. This portion moves and locks an object when the wrench is rotating in one direction and releases the object when rotation in an opposite direction. It is ratchet-like wrench.

Pub. 2010/0083798 A1 describes an adjustable wrench structure that includes a main body, a movable body and an adjusting wheel. The adjusting wheel is located at a rear section of the wrench, so an operator does not have to move hands forward and backward.

An object of the present invention is to provide an improved adjustable wrench using simultaneous force distribution on a sloping surface and a friction force to lock a jaw. That leads to multiple variants of the adjustable wrench.

Sloping surfaces was used in wrench designs as a lock, however, a sliding jaw with a sloping abutment surface was newer used as a locking devise.

SUMMARY OF THE INVENTION

The object is achieved by the adjustable wrench with the features of the claims 1 and 4. Preferred embodiments are disclosed in the depending claims.

The adjustable wrench comprising a base element and a sliding element. Said base element comprising a longitudinal handle section extending in a longitudinal direction and a first abutment section protruding from the handle section. Said sliding element comprising a longitudinal slider section parallel to the handle section and being slide guided on the handle section and a second abutment section protruding from the sliding section. Said first and second abutment section each comprising abutment surfaces, and abutment surfaces being arranged face to face to each other to clamping a nut between abutment surfaces of the first and second abutment sections.

By alignment of the abutment surface of the second abutment section in an angle of maximal 60 degrees between the abutment surface and a longitudinal direction of the handle section, any additional force provided on said abutment surface of the second abutment section in conterdirection of the first abutment section which may a result in opening the wrench by sliding back of the sliding element is prevented.

In a preferred embodiment, said abutment surface of the first abutment section is aligned in an external angle of maximal 60 degrees approximately between the abutment surface and longitudinal direction of the handle section, said external angle being located outside of the abutment section, and said abutment surface of the second abutment section is aligned in an internal angle of maximal 60 degrees between the abutment surface and the longitudinal direction of the handle section, and the internal angle being located inside the abutment section.

In a further preferred embodiment, at least one of the abutment surfaces is rough in an order to hindering the nut from slipping of the wrench and ensure that a force applied to the sliding element in a direction to the first abutment surface securely holding the base element and the sliding element in a clamping position when turning the wrench. The desired direction of rotation that applied a force to the sliding element is from the abutment surface to the handle defined by an angle of maximal 60 degrees, an opposite direction is idle.

A rough surfaces can be provided, for example, by protrusions, slots, groves on at least at the sliding abutment surface or other means like additional material fixed on the abutment surface, said additional material being rougher than the adjacent abutment surface.

In an another preferred embodiment a finger is mounted on a sliding element protruding from the sliding element in a distance to the second abutment element. By providing the finger a secure fastening connection between the base element and the sliding element of the wrench is released in order to open the wrench.

In still an another preferred embodiment when an adjustable wrench comprising a base element and a sliding element, said base element comprising a handle section extending in a longitudinal direction and a first abutment section with two abutment surfaces located by 60 degrees to each other and protruding from the handle section; and the sliding element comprising a longitudinal sliding section and a second abutment section with an abutment surface located by 60 degrees angle approximately to both abutment surfaces of the first abutment section and protruding from the sliding section; and the abutment surface of the second abutment section is set by an angle of maximal 60 degrees approximately to a direction of a sliding element movement.

The wrench may have a lever element comprising a first lever section and a second lever section pivotally mounted on the sliding element. Preferably, the first lever section comprises a hinge for pivotally mounting the first lever section on the sliding element. Said first lever section then extends transversely to the longitudinal direction of the handle and comprises at least one snap-in element or high friction element for releasable engaging the first section with the handle section of the base element at a side opposite to the sliding element. The lever second section extends transversely to the first section in a direction away from the abutment section.

A release spring element may extend between the second lever section of the lever element and the handle section of the base element. A resilient element can be put under a hinge axel to extend a width range.

That is logical, it can be an opposite situation when the first abutment section is located on the sliding element, and the second abutment section is located on the handle section, and, as in the previous case, at least the handle abutment surface should have a high level of friction by providing slots, groves or using special materials.

The adjustable wrench has a bias spring element that is extending between the sliding element and the base element, that spring provides a bias force of the second abutment section towards the first abutment section.

A sloping surface allows to distribute an applied force such a way that using a screw for a jaw movement or other auxiliary means becomes unnecessary. The presser for a jaw fixation is produced by the sliding element shape and a high friction on the sliding abutment surface.

DETAILED DESCRIPTION OF THE DRAWING

Figure 1:
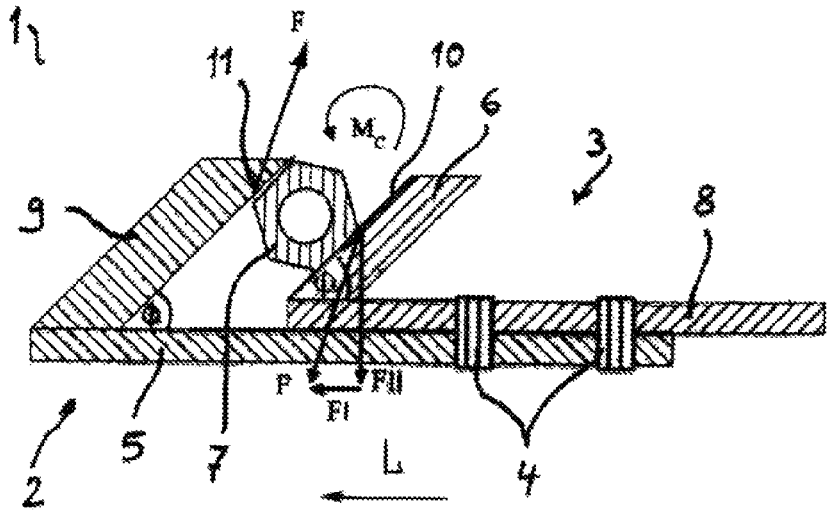
FIG. 1 is showing forces distribution on wrench elements.

FIG. 1 shows a schematic drawing of an adjustable wrench 1 comprising a base element 2 and a sliding element 3. Said sliding element 3 is movable arranged on the base element 2 in a longitudinal direction L that is an extension of both the base element 2 and the sliding element 3. Guide members 4, e.g. in form of a tunnel formed by a bent metal plates fixed on the base element 2 and arranged in alignment to each other such that the sliding element 3 protrudes through the tunnel to be slide guided in longitudinal direction L.

Alternative solutions for the guide members 4 are also useful, like guides having dovetails, grooves and tongues and there like. These guide members 4 may be provided in any or all of the embodiments described below and in any or all of the embodiments falling in the scope and a spirit of the present invention.

Said base element 2 comprises a longitudinal handle section 5 extending longitudinal in the longitudinal direction L and further comprising a first abutment section 9 protruding from the base element said handle section 5 intended for clamping a nut 7. The sliding element 3 comprises a longitudinal slider section 8 extending parallel to the handle section 5 and being slide guided on the handle section 5 as explained above. Said sliding element 3 further comprising a second abutment section 6 protruding from the slider section 8 being arranged to clamp a nut 7.

Both the first and second abutment sections 6, 9, each comprises abutment surfaces 10 and 11 being arranged face to face to each other for clamping a six-cornered nut 7 between two abutment surfaces.

The abutment surface 10 of the second abutment section 6 of the sliding element 3 should be—according to the present invention—aligned in an angle Φ of maximal 60 degrees between the abutment surface 10 and the longitudinal direction of the handle section 5.

As shown in FIG. 1, the resulting force applied to the sliding element 3 when turning the wrench 1 anticlockwise for loosening or fastening the nut 7 is directed towards the fixed first abutment section 9, so that no additional force is applied to the sliding element 3 which could cause an opening of the wrench 1 by sliding back of the sliding element 3 away from the first abutment section 9.

Thus, the adjustable wrench 1 is self clamping without need of any strong snap-in or screw element otherwise being required for fixing the sliding element 3 onto the base element 2 after embracing the nut 7. A resulting force F applied to the second abutment sections 6 can be divided into a first fraction of the force F1 directed longitudinal in the direction L of the base 2 and into a second fraction of the force F11 directed perpendicular to this first fraction.

A trigonometric relation of the first fraction F1 and the force F is $$F1=F\sin(60°-\Phi),$$

wherein the angle Φ is the angle between the abutment surface 10 and the longitudinal direction of the handle section 5. It should be noted that the sinus value will be negative in case of an angle Φ greater that 60°, i.e. the direction of the first fraction of force F1 would then be away from the first abutment section 9 causing the sliding element 3 to move away from this first abutment section 9 so that the adjustable wrench 1 would be opened when an additional force along the line L is not applied.

Figure 2:
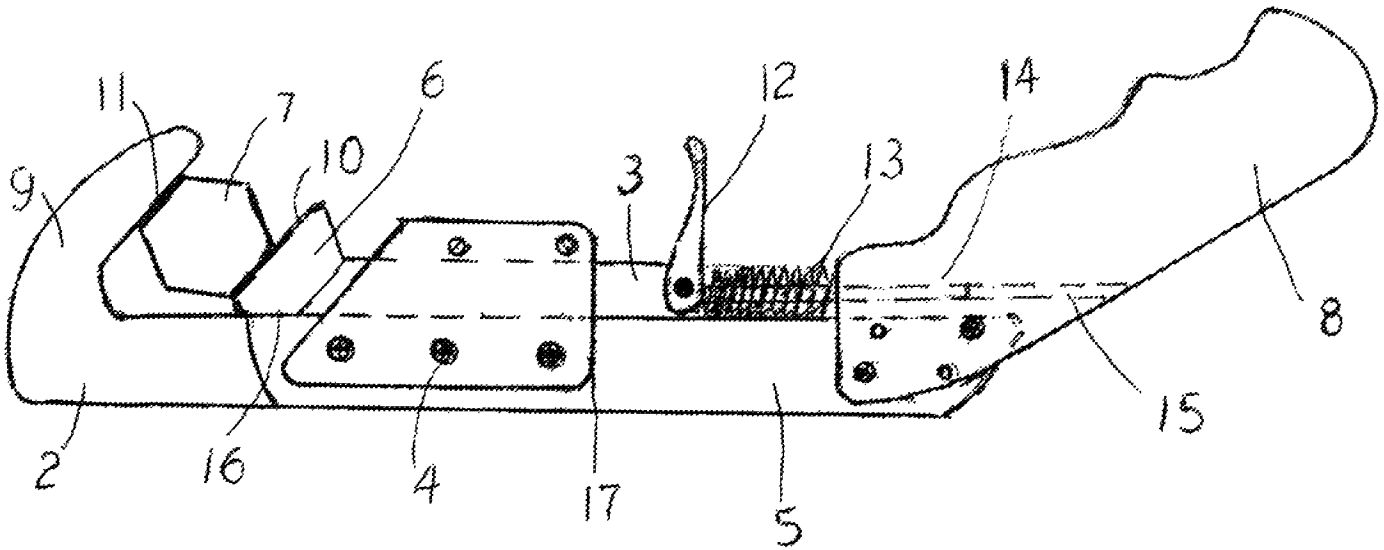
FIG. 2 is a side view of a preferred embodiment according to the present invention.

FIG. 2 shows a drawing of a second embodiment of the adjustable wrench. The longitudinal handle section 5 of the base element 2 is bent upwardly at its free end in the direction according to the adjacent first abutment section 9 of the base element 2. The advantage is that gripping and handling of the wrench is much easier.

Further, it can be seen that a finger 12 is mounted on the free end of the sliding element 3 opposite to the second abutment section 6. The finger 12 has a curved outer surface.

A spring 13 is provided between the free end of the handle section 5 and the adjacent free end of the sliding element 3. The bias spring 13 is fastened to the finger 12 to provide a bias force on the finger 12 preferably in closing direction to secure the sliding element (shank) The shank 3 is release ably fixed on the base element 2, e.g. after embracing the nut 7.

Referring to drawing FIG. 2, the wrench has the base element 2 with an abutment surface 11, a handle 8, the retractable shank 3 has an abutment surface 10 that is located approximately parallel to the base part abutment surface 11.

A spring 13, and means to move the retractable shank (that are the lever 12 and a spring pin 14 which can be welded together), wherein the retractable shank abutment surface sets by an angle maximal of 60 degrees to a line of a retractable shank motion and the spring 13 forces abutment surfaces to each other.

A handle 8 has a channel 15 to except a spring pin 14. The handle can be fixed to the base section by screws.

Improving reliability, at least the shank abutment surface can be covered with a high friction material, for example, by a diamond dust. It is necessary to use two plates 17 to keep all parts together. They are fixed to the base section and have rivets on a top.

When providing an operation with the wrench an operator pools the shank by the lever 12 and than releases it when a fastener head (a nut) is located between abutment surfaces. Because a sloping surface creates a force that push shank forward and friction prevents shank's movement when the wrench is engaged, the fastener head is fixed between the abutment surfaces when wrench turns anticlockwise, from handle to the abutment surface, an opposite direction is idle. It is clear that the design can be changed when the shank is a fixed part and the base section is retractable.

A third embodiment of the adjustable wrench has a V-shape abutment surface. Simplifying a design the base element is made movable and the element with a slopping abutment surface (the sliding element in the previous embodiment) has a handle.

Figure 3:
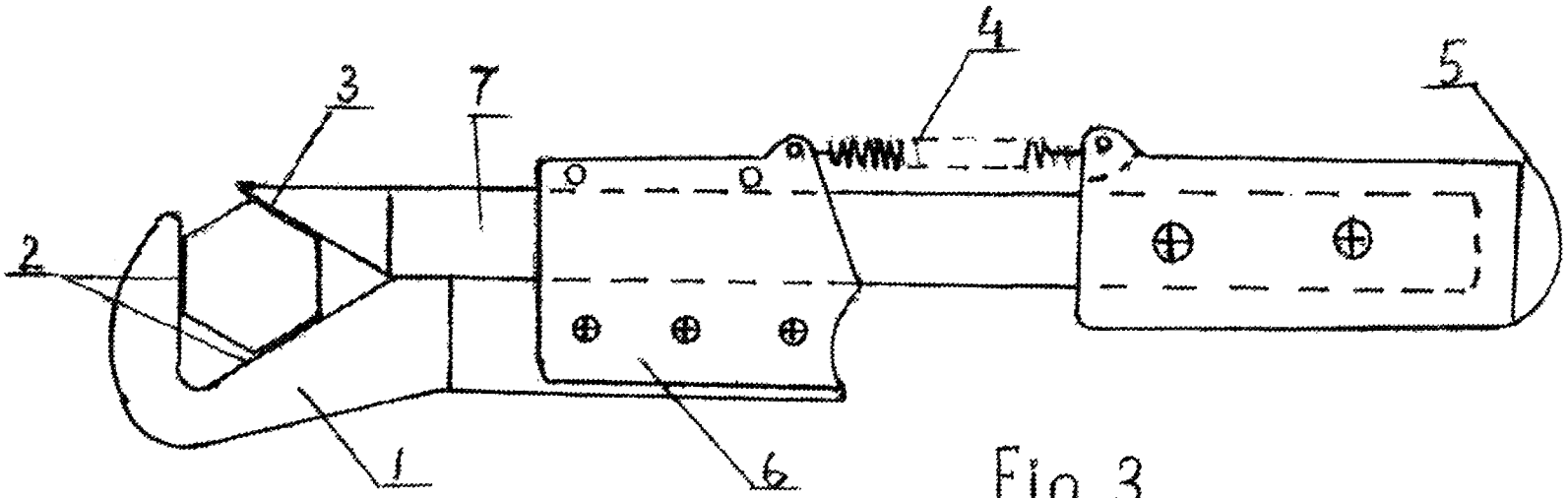
FIG. 3 is a side view of a third embodiment according to the present invention.
Figure 4:
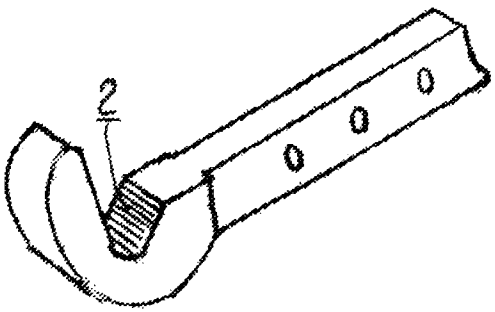
FIG. 4 is a perspective view of a sliding hook according to the third embodiment of the present invention.
Figure 5:
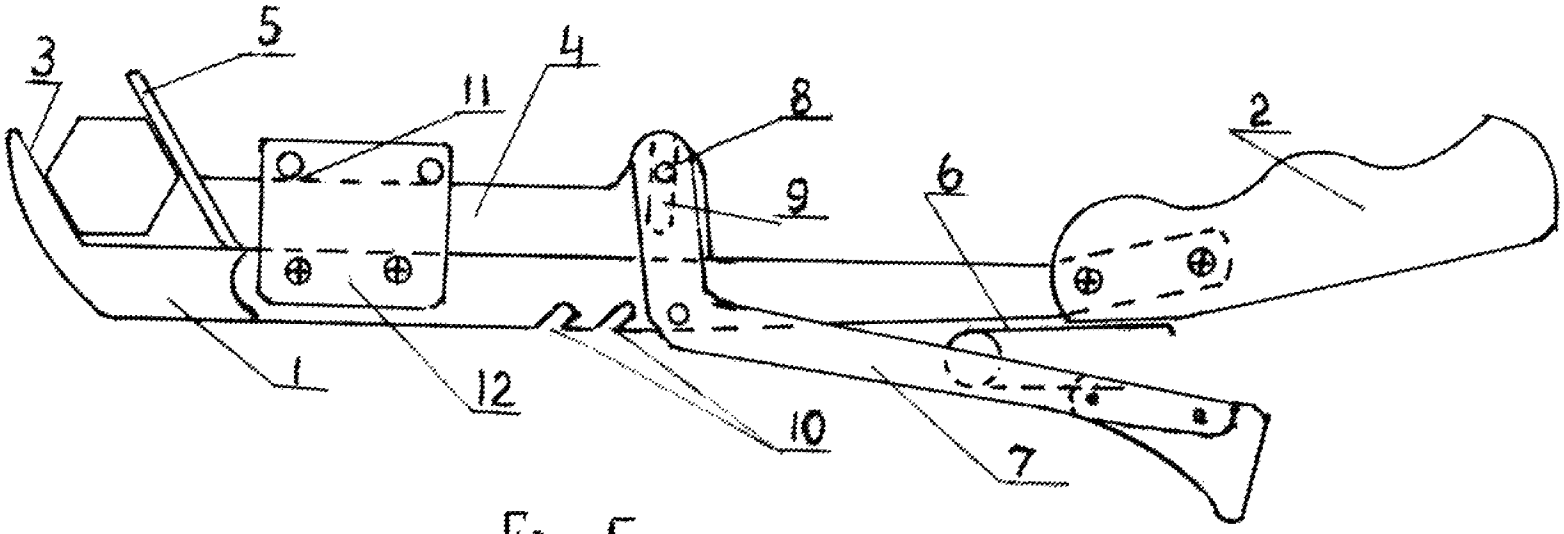
Figure 6:
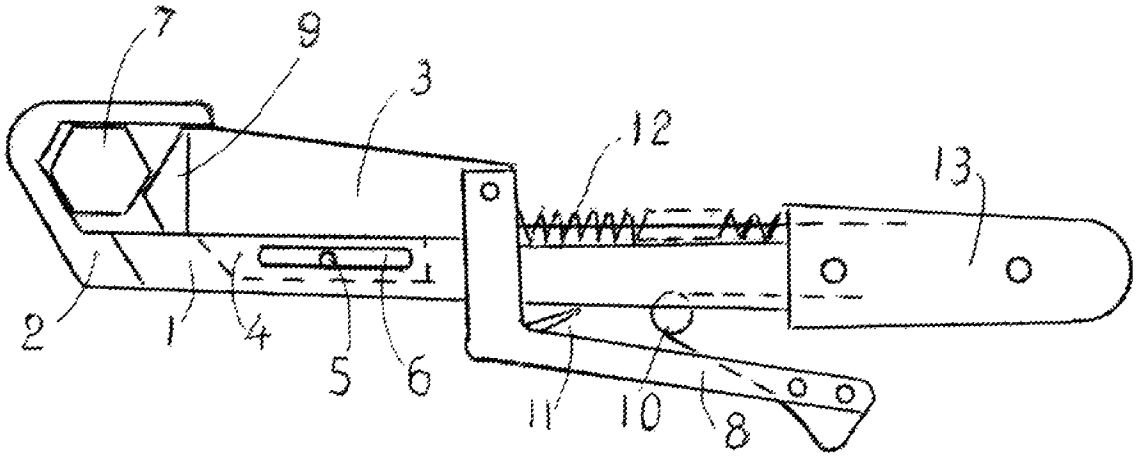
Figure 7:
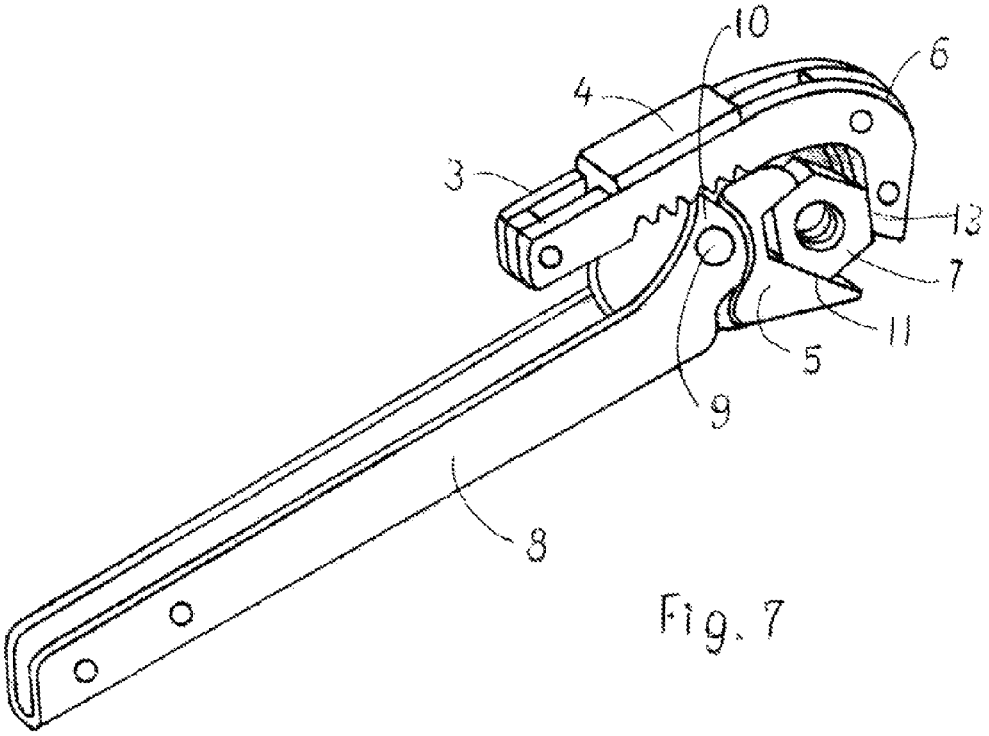
Figure 8:
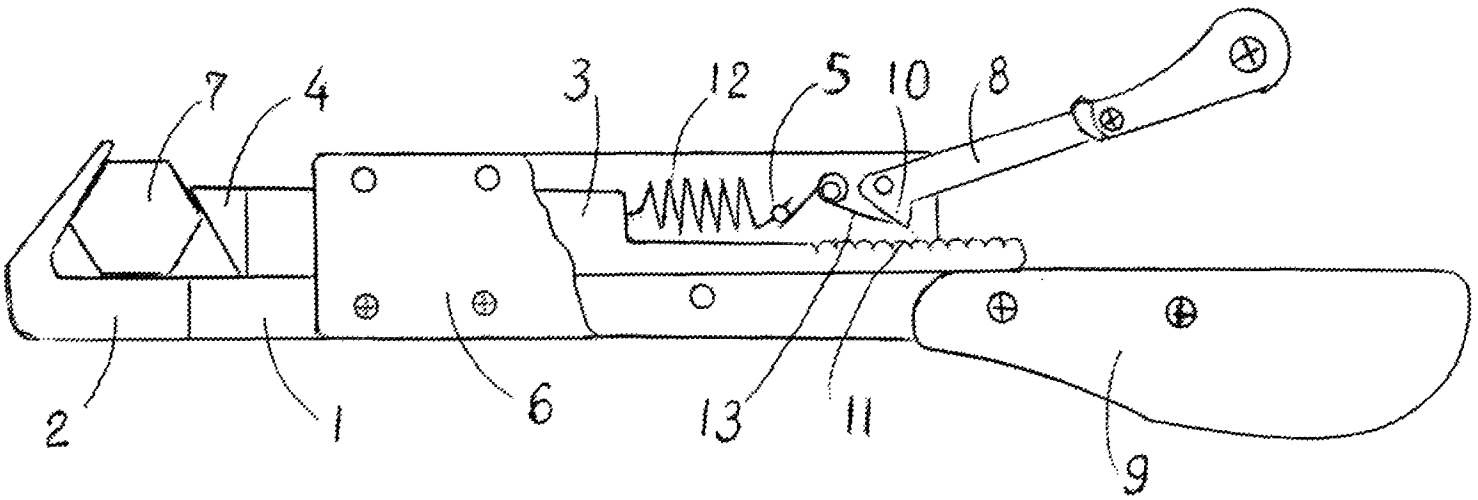

Referring to drawings FIGS. 3 and 4, the adjustable wrench comprising a base element 1 with two or several abutment surfaces 2, when at least two of them are located by the angle approximately 60 degree to each other, another part 7 with a handle 5 has a slopping abutment surface 3 which sets by the angle of 60 degrees approximately to both base element abutment surfaces, when said two elements (parts) can move relative to each other, wherein the part with the sloping abutment surface that sets by the angle of maximal approximately 60 degrees to a direction of a retractable part motion and the base element (retractable part in this design) is moving by a bias spring 4 in a close position. FIG. 4 showing a sliding base element 1 with the abutment surface 2. Instead of the spring in this design a lever can be used and an angle between the abutment surface 3 and a direction of a base element 1 movement can be chosen more than 60 degrees but less than 90 degrees.

In this design the base part 1 is retractable when the part with the sloping surface is fixed part and has a handle 5. It is clear that it can be vise versa design.

Two plates 6 with two rivets on a top are fixed to the base element 1 by screws.

Using this design wrench an operator has to push the base part of the wrench and put the wrench over a fastener. When a presser on the base part released the spring 4 moves the base part back and locks the fastener from three sides.

The invention claimed is:

1. An adjustable nut wrench comprising a base element and a sliding element, said base element comprising a handle section extending in longitudinal direction and a first abutment section protruding from the handle section;

and the sliding element comprising a longitudinal sliding section extending parallel to the longitudinal handle section and being slide guided on the handle section, and a second abutment section protruding from the sliding section;

and the first and second abutment sections each comprising an abutment surface, and the abutment surfaces being arranged face to face to each other for clamping a nut between the abutment surfaces of the first and second abutment sections and a spring forces abutment surfaces to each other, wherein said abutment surface of the second abutment section is aligned in an angle between 20 and 60 degrees approximately between the abutment surface and a longitudinal direction of the handle section and at least the abutment surface of the sliding section has high level of friction that allows the wrench to be self clamping without any auxiliary locking or suppressing means, and wherein in a case of an external location the first abutment surface the working wrench rotation direction is from the abutment surface to the handle, an opposite direction is idle, and wherein in a case of an internal location the first abutment surface the working rotation direction of the wrench is from handle to the first abutment surface, an opposite direction is idle, and wherein the sliding section can be freely moved by hand or by spring when the wrench is not in the working position.

2. An adjustable nut wrench according to claim 1, wherein a finger is mounted on a free end of the sliding element protruding from the sliding element in a direction of the second abutment section.

3. An adjustable nut wrench according to claim 1, wherein at least one of the abutment surfaces is rough comprising protrusions, slots, groves or a material with a high friction.

4. An adjustable nut wrench comprising a base element and a sliding element, said base element comprising a handle section extending in a longitudinal direction and a first abutment section with two abutment surfaces located by 60 degrees to each other and protruding from the handle section; and a second sliding abutment section with a flat abutment surface located by 60 degrees angle approximately to both abutment surfaces of the first abutment section and protruding from the sliding section;

wherein the abutment surface of the second abutment section is set by an angle between 20 and 60 degrees approximately to a direction of the sliding element movement and at least the abutment surface of the sliding element has high level of friction that makes the wrench self locking;

and wherein the working rotation direction of the wrench is from the abutment surface to the handle, opposite direction is idle.

5. An adjustable nut wrench according to claim 4, wherein a bias spring element is extending between the sliding element and the base element, wherein the spring provides a bias force for the second abutment section.

6. An adjustable nut wrench according to claim 4, wherein at least one of the abutment surfaces are rough comprising protrusions, slots, groves or a high friction material.

7. An adjustable nut wrench according to claim 4, wherein the first abutment section locates on the sliding element, and the second abutment section is located on the handle section and at least a handle abutment surface have a high level of friction.

8. An adjustable nut wrench according to claim 4, comprising a base element and a sliding element, and the base element comprising a first abutment section and a sliding element comprising slider section extending parallel to the base section and being guided by a lever, wherein the angle between the sliding element abutment surface and a direction of the sliding section movement is between 61 and 82 degrees.

* * * * *